United States Patent [19]

Geertsma et al.

[11] Patent Number: 4,926,550

[45] Date of Patent: May 22, 1990

[54] SHAVING APPARATUS

[75] Inventors: Geert Geertsma; Hendrik Poel; Andreas Weersink, all of Drachten, Fed. Rep. of Germany

[73] Assignee: U.S. Philips Corp., New York, N.Y.

[21] Appl. No.: 300,402

[22] Filed: Jan. 19, 1989

[30] Foreign Application Priority Data

Feb. 18, 1988 [NL] Netherlands ..... 8800406

[51] Int. Cl.[5] ..... B26B 19/14

[52] U.S. Cl. ..... 30/43.1; 30/43.6

[58] Field of Search ..... 30/43.5, 43.6, 346.51, 30/43.2, 43.1

[56] References Cited

U.S. PATENT DOCUMENTS 4,318,223 3/1982 Bergsma et al. ..... 30/43.6

*Primary Examiner*—Douglas D. Watts

*Attorney, Agent, or Firm*—Ernestine C. Bartlett

[57] ABSTRACT

A shaving apparatus is provided which comprises a housing with a holder for at least one shaving unit, which shaving unit comprises an external shaving member with hair entry apertures and an internal shaving member which is rotatable relative to the external shaving member, the holder comprising a support with a resilient element which acts on the external shaving member. The apparatus comprises an adjustment mechanism for adjusting the stiffness of the resilient element.

3 Claims, 2 Drawing Sheets

SHAVING APPARATUS

FIELD OF THE INVENTION

The invention relates to a shaving apparatus having a housing comprising a holder for at least one shaving unit, which shaving unit comprises an external shaving member with hair-entry apertures and an internal shaving member which is rotatable relative to the external shaving member, the holder comprising a support with a resilient element which acts on the external shaving member.

BACKGROUND OF THE INVENTION

Such a shaving apparatus is known, for example from U.S. Pat. No. 3,913,225. In this known apparatus the force with which a shaving unit is applied to the skin to be shaved depends on the extent to which a shaving unit is pressed inwards against the action of the resilient element. This force has its maximum value if the shaving unit is pressed completely into the holder. However, it is desirable that the user can vary this maximum force between the shaving unit and the skin to adjust it to his personal preference.

SUMMARY OF THE INVENTION

An object of the invention is to meet this requirement and to this end the invention provides an apparatus which comprises an adjustment mechanism for adjusting the stiffness of the resilient element.

In special embodiments the resilient element is provided with curved arms having end portions that act on the external shaving member, and wherein the resilient element and the support are rotatable relative to one another by means of an adjusting member arranged in the holder wall, the free length of each curved arm being adjustable relative to a projection provided on the support and associated with the arm.

BRIEF DESCRIPTION OF THE DRAWING

An embodiment of the invention will now be described in more detail, by way of example, with reference to the Figures.

DETAILED DESCRIPTION OF THE PREFERRED EMBODIMENTS

Figure 1:
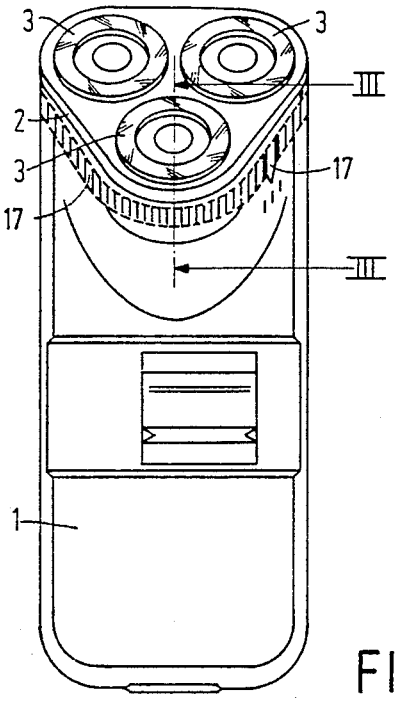
FIG. 1 is a front view of a shaving apparatus in accordance with the invention.
Figure 2:
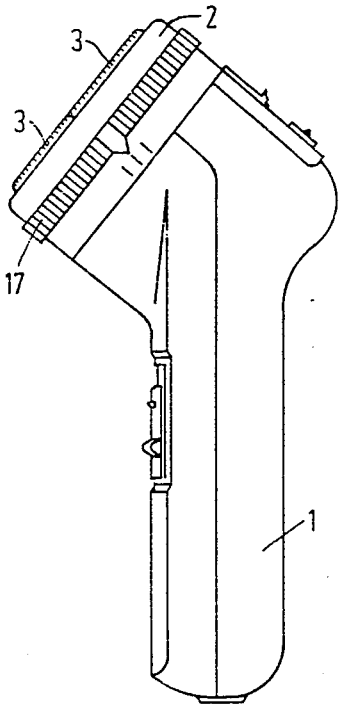
FIG. 2 is a side view of the shaving apparatus shown in FIG. 1.
Figure 3:
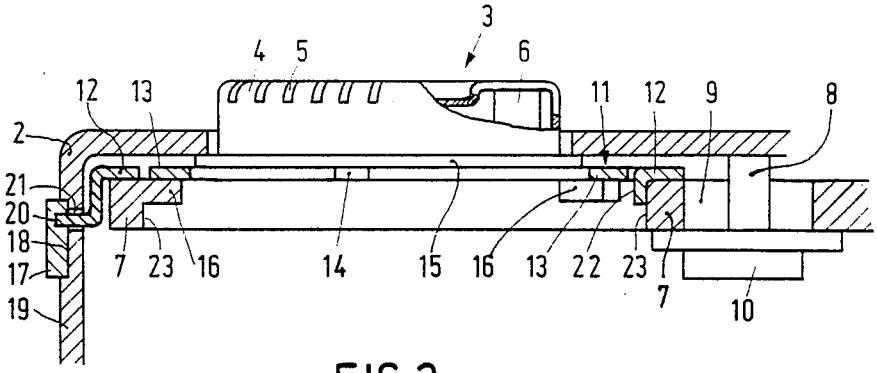
FIG. 3 is a sectional view taken on the line III—III in FIG. 1.

The shaving apparatus shown in the Figures comprises a housing 1 with a holder 2 for three shaving units 3. A shaving unit 3 comprises an external shaving member 4 with hair entry apertures 5, and an internal shaving member 6 which is rotatable relative to the external shaving member. The internal shaving members can be driven by means of an electric motor with is accommodated in the housing and which in known manner is coupled to the internal shaving members. For the sake of simplicity this drive mechanism is not shown in the Figures.

A support 7 is arranged inside and secured to the holder 2. For this purpose the holder 2 is provided with a central pin 8 which extends through a central aperture 9 in the support 7. A fixing knob 10 is screwed onto the end portion of the central pin 8.

For each shaving unit 3 the support 7 carries a resilient element 11 comprising an annular portion 12, engaging with the support 7, and circularly curved arms 13. The inwardly directed end portions 14 of the resilient arms 13 engage against the flange 15 of the external shaving member 4. For every arm 13 the support 7 is provided with a projection 16 supporting the arm.

The resilient element 11 is rotatable relative to the support 7 and is adjustable to different positions by means of a flexible adjusting band 17 which engages in a circular groove 18 in the wall 19 of the holder 2. For this purpose each resilient element 11 is provided with a tab 20 which extends through an opening 21 in the wall of the holder and which is anchored to the adjusting band 17. The annular portion 12 of a resilient element 11 also comprises bent tabs 22 which engage in a central opening 23 in the support 7, thereby rotatably supporting the resilient element 11 on the support 7.

Figure 4:
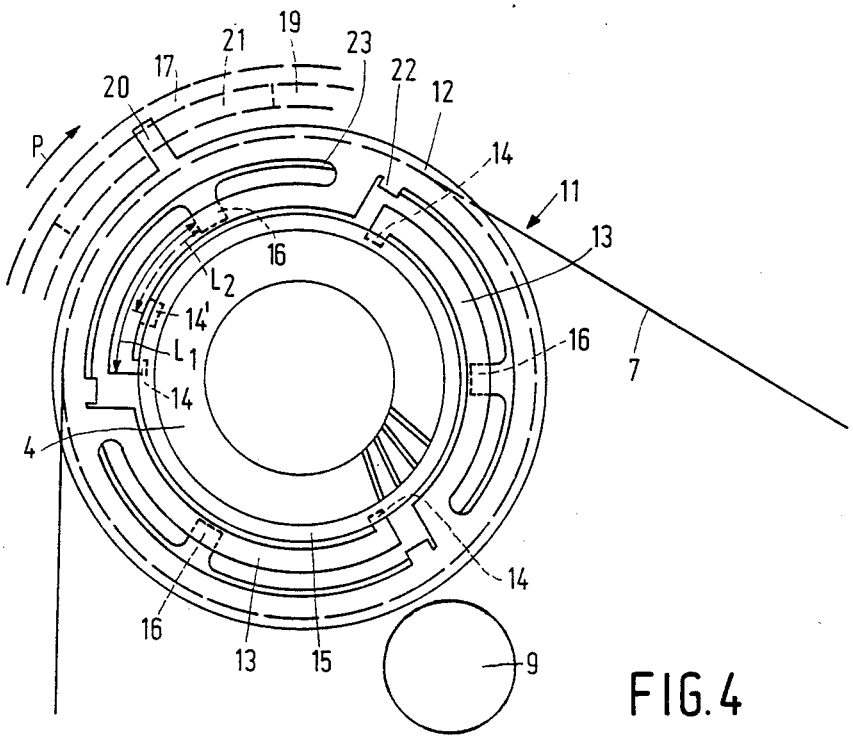
FIG. 4 is a partial plan view of the mounting plate used in the embodiment shown in FIG. 3.

By moving the adjustment band 17 in the direction indicated by the arrow P (FIG. 4) the resilient element 11 can be rotated in the same direction relative to the support 7. An end portion 14 of an arm 13 can thus assume a position 14' as indicated in broken lines in FIG. 4. The free length of an arm 13 relative to the projection 16 is thus reduced from $L_1$, $L_2$. The stiffness of the arm 13 increases to an extent corresponding to said reduction. In the situation of the end portion 14 relative to the projection 16 as indicated in solid lines in FIG. 4 depression of a shaving unit 3 over a specific distance against the action of a resilient element 11 will require a smaller force than the depression over the same distance in the situation indicated in broken lines.

Figure 5:
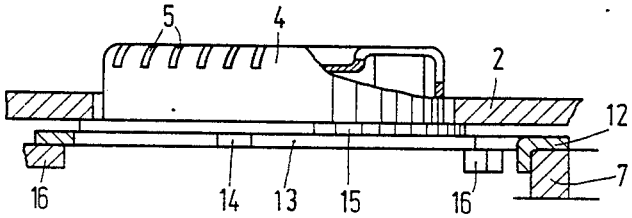
FIGS. 5 and 6 are simplified sectional views similar to that shown in FIG. 3, showing a shaving unit in different positions.
Figure 6:
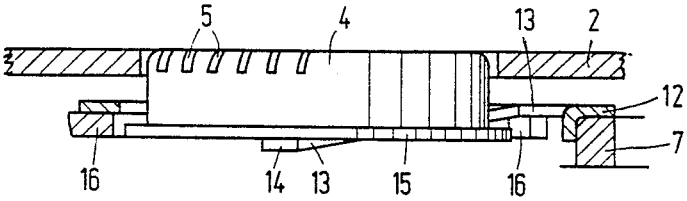

During shaving the external shaving member 4 may be pressed inwards over the maximum distance (FIG. 6) relative to the unloaded situation (FIG. 5), i.e. so far that the external shaving member 4 no longer projects from the holder 2. The maximum force then acting between the skin to be shaved and the external shaving member may result in the skin slightly penetrating the hair entry apertures 5 and being grazed by the internal shaving member 6. This irritation is generally not noticed until after shaving.

In the manner described above the user of the shaving apparatus, however, can adjust the maximum force which an external shaving member 4 and hence the entire shaving unit, is applied to the skin and can adapt this maximum force to his personal preference.

In general, the shaving apparatus in accordance with the invention can be adjusted to provide a stiff or less stiff resilient support of the shaving unit 3.

Obviously, it is also possible to use a construction in which the support instead of the resilient element is rotated. For example, the support may then be mounted for rotation in a supporting unit secured inside the holder.

What is claimed is:

1. A shaving apparatus having a housing comprising a holder for at least one shaving unit, which shaving unit comprises an external shaving member with hair entry apertures and an internal shaving member which is rotatable relative to the external shaving member, the holder comprising a support with a resilient element which acts on the external shaving member, whereas the apparatus comprises an adjustment mechanism for adjusting the stiffness of the resilient element.

2. A shaving apparatus having a housing comprising a holder for at least one shaving unit, which shaving unit comprises an external shaving member with hair entry apertures and an internal shaving member which is rotatable relative to the external shaving member, the holder comprising a support with a resilient element which acts on the external shaving member wherein the apparatus comprises an adjustment mechanism for adjusting the stiffness of the resilient element and wherein the resilient element is provided with curved arms with end portions that act on the external shaving member, the resilient element and the support being rotatable relative to one another by means of said adjustment mechanism arranged in the holder wall, the free length of each curved arm being adjustable relative to a projection provided on the support and associated with the arm.

3. A shaving apparatus as claimed in claim 2 wherein the end portions of said arms engage against the flange of the external shaving member; and movement of the adjusting member reduces the free length of the arm relative to the projection, the stiffness of the arm being increased to the extent that the free length is reduced.

* * * * *